US005604782A

United States Patent [19]

Cash, Jr.

[11] Patent Number: 5,604,782

[45] Date of Patent: Feb. 18, 1997

[54] SPHERICAL MIRROR GRAZING INCIDENCE X-RAY OPTICS

[75] Inventor: Webster C. Cash, Jr., Boulder, Colo.

[73] Assignee: The Regents of the University of Colorado, Boulder, Colo.

[21] Appl. No.: 514,134

[22] Filed: Aug. 11, 1995

Related U.S. Application Data

[63] Continuation of Ser. No. 241,098, May 11, 1994, abandoned.

[51] Int. Cl.[6] ..... G21K 1/06

[52] U.S. Cl. ..... 378/85; 378/145; 250/353; 359/858

[58] Field of Search ..... 378/84, 85, 145; 250/353; 359/856, 857, 858, 730

[56] References Cited

U.S. PATENT DOCUMENTS

| | | | |
|---|---|---|---|
| 2,557,662 | 6/1951 | Kirkpatrick | 378/70 |
| 2,941,078 | 6/1960 | Montel | 378/70 |
| 4,810,077 | 3/1989 | Sting | 359/387 |
| 5,031,199 | 7/1991 | Cole, III et al. | 378/34 |
| 5,042,931 | 8/1991 | Mourier | 359/858 |
| 5,528,364 | 6/1996 | Koike | 356/334 |

FOREIGN PATENT DOCUMENTS 59-005218 1/1984 Japan .

OTHER PUBLICATIONS

B. Lai, et al., "A New Undulator Grazing Incidence Monochromator", Nuclear Instruments and Methods in Physics Research, vol. A246 publ. 1986, North–Holland, Amsterdam, pp. 297–302 no month.

K. P. Beuermann, et al., "Properties of transmission grating behind a grazing incidence telescope for cosmic x–ray spectroscopy", Applied Optics, May 1977, vol. 16, No. 5, pp. 1425–1431.

I. V. Peisakhson, et al., "Calculation of optimal parameters of a grazing–incidence monochromator with concave holographic grating", The Optical Society of America, 1985, pp. 294–297 no month.

J. Lurie, "Anastigmatic catadioptric telescopes", Journal of the Optical Society of America, vol. 65, No. 3, Mar. 1975, pp. 261–266.

*Primary Examiner*—David P. Porta
*Assistant Examiner*—David Vernon Bruce
*Attorney, Agent, or Firm*—F. A. Sirr; E. C. Hancock

[57] ABSTRACT

An optical system for x-rays combines at least two spherical or near spherical mirrors for each dimension in grazing incidence orientation to provide the functions of a lens in the x-ray region. To focus x-ray radiation in both the X and the Y dimensions, one of the mirrors focusses the X dimension, a second mirror focusses the Y direction, a third mirror corrects the X dimension by removing comatic aberration and a fourth mirror corrects the Y dimension. Spherical aberration may also be removed for an even better focus. The order of the mirrors is unimportant.

11 Claims, 3 Drawing Sheets

| | X DIRECTION | Y DIRECTION | NOTES |
|---|---|---|---|
| $r$ | $\infty$ | $\infty$ | OBJECT AT INFINITY |
| $R_1$ | 237,382 mm | 213,062 mm | RADIUS, FIRST SPHERE |
| $\Theta_1$ | 2 DEGREES | 2 DEGREES | GRAZE ANGLE, FIRST SPHERE |
| $r'$ | 4142.25 mm | 3717.88 mm | FOCUS, FIRST SPHERE |
| $d$ | 600.0 mm | 600.0 mm | DISTANCE BETWEEN ELEMENTS |
| $r_2$ | −3542.25 mm | −3117.88 mm | DISTANCE FROM FIRST FOCUS TO SECOND SPHERE |
| $\Theta_2$ | 2 DEGREES | 2 DEGREES | GRAZE ANGLE, SECOND SPHERE |
| $R_2$ | 430,737 mm | 372,865 mm | RADIUS, SECOND SPHERE |
| $r'_2$ | 2401.03 mm | 2101.03 mm | DISTANCE TO FOCAL PLANE |
| $M_{31}$ | $1.776\times10^{-11}$ | $2.204\times10^{-11}$ | COMA, COEF. FIRST SPHERE |
| $M_{32}$ | $2.881\times10^{-11}$ | $3.805\times10^{-11}$ | COMA, COEF. SECOND SPHERE |
| $\sigma_3$ | −.62536 | −.58978 | |
| $M_3$ | $-2.593\times10^{-13}$ | $-3.990\times10^{-13}$ | TOTAL COMA COEF. |
| $M_{41}$ | $4.813\times10^{-15}$ | $6.656\times10^{-15}$ | SPH. ABBERATION, COEF. FIRST SPHERE |
| $M_{42}$ | $2.010\times10^{-14}$ | $3.025\times10^{-14}$ | SPH. ABBERATION, COEF. SECOND SPHERE |
| $\sigma_4$ | .53477 | .49460 | |
| $M_4$ | $1.556\times10^{-14}$ | $2.162\times10^{-14}$ | TOTAL SPHERICAL ABBERATION COEF. |

FIG. 5

SPHERICAL MIRROR GRAZING INCIDENCE X-RAY OPTICS

This invention was made with Government support awarded by NASA. The government has certain rights in this invention.

This application is a continuation of Ser. No. 08/241,098 filed May 11, 1994, now abandoned.

BACKGROUND OF THE INVENTION

1. Field of the Invention

This invention relates to apparatus and methods for optically processing x-rays. In particular, this invention relates to the use of spherical mirrors in grazing incidence to focus, image, collimate, and perform interferometry in the x-ray band of the spectrum. The present invention is particularly useful for the full range of x-ray imaging, especially for improving the quality of focus of the final image, and for x-ray lithography.

2. Description of the Prior Art

The value of the refractive index of materials in the soft x-ray band is slightly below one, and coupled to a high absorption coefficient. The high absorption has made all attempts at refractive x-ray optics unsatisfactory to date. Three approaches are used: zone plates, normal incidence multilayer mirrors, and grazing incidence mirrors.

The zone plate images through use of diffraction. Concentric rings are ruled on a thin sheet and diffract some of the radiation to the center where an image forms. The systems are typically inefficient due to the physics of diffraction, and the resultant image usually has severe chromatic aberrations.

Multilayer mirrors are made by depositing alternating thin layers of two elements with different indices of refraction. This creates constructive interference, and hence high reflectivity at one wavelength. The approach has the advantage that it can be used with normal incidence optics, but has the drawback of very limited spectral bandpass. Multilayers are used at wavelengths longer than about 4 nm because below this it is difficult to achieve adequate layer to layer coherence.

Grazing incidence optics make use of the fact that the index of refraction is below one, allowing radiation incident at a low graze angle to experience total external reflection. Grazing incidence mirrors also have the advantage that polish requirements drops as a function of $\sin\theta$, where $\theta$ is the graze angle, avoiding the need for sub-nanometer surface quality, even well into the x-ray spectrum.

The first optical designs based on grazing incidence were described by Kirkpatrick and Baez (K-B) in 1948 (1951 patent). They used flats, spheres and cylinders to create a one dimensional line focus. The second dimension of focus is achieved by a second optic placed beyond the first, oriented at 90-degrees. This arrangement has severe comatic aberration that limits the utility in high resolution applications. It was not appreciated until now that two spherical mirrors for each dimension of focus could be selected and oriented to minimize coma and also spherical aberration.

In 1952, Wolter described a system of extreme aspherical paraboloids, hyperboloids, and ellipsoids that produced high resolution images on-axis and better off-axis resolution. Unfortunately, the difficulty and expense of manufacturing and aligning extreme aspheres has limited both the availability and ultimate quality of the optics.

One recent variation of this approach is to replace the paraboloid and hyperboloid of a typical Wolter with two toroids. This allows a diverging synchrotron beam to be collimated into a straight, narrow line with two grazing incidence reflections. A device of this nature is disclosed in U.S. Pat. No. 5,031,199 by Cole et al. However, the aberration control of toroids is significantly poorer than that of spheres, their fabrication cost is much higher, and their resultant optical fabrication quality is much lower in terms of figure and scatter.

A need remains in the art for apparatus and methods for optically processing x-rays inexpensively and without significant comatic or spherical aberrations.

SUMMARY OF THE INVENTION

An object of the present invention is to provide methods and apparatus for optically processing x-rays inexpensively, and without significant comatic or spherical aberrations. This object is achieved by providing a system of grazing incidence mirrors, fabricatable to high tolerance by standard optical techniques, that will support high resolution focusing, imaging, collimation and interferometry in the x-ray band of the spectrum. In this specification, the term "focussing" is intended to include line and point focussing, imaging, and collimating, unless otherwise stated.

In accordance with this invention, incident radiation between an object and a focal plane is processed by a first and a second mirror having spherical surfaces. The mirrors are oriented so that the object radiation reflects off the first mirror in grazing orientation, and then reflects off the second mirror in grazing orientation onto a focal plane, whereby the comatic aberration of extremum rays is reduced at least to the level of spherical aberration of extremum rays. Both coma and spherical aberration of extremum rays may be reduced to the level of fifth order aberration. This setup may be used to line focus radiation, for example.

In accordance with this invention, incident radiation from an object may be focussed in two dimensions onto a focal plane by orienting four spherical mirrors so that the incident radiation reflects off each in turn in grazing orientation, such that the comatic aberration of extremum rays is reduced to the level of spherical radiation, or so that both coma and spherical radiation of extremum rays are reduced to the level of fifth order aberration.

An x-ray interferometer, in accordance with the present invention, includes at least six spherical mirrors. Three of the mirrors, in grazing incidence to a first beam, focus the first beam onto a focal plane, and three other mirrors, in grazing incidence to a second beam, focus the second beam onto the focal plane so that the two beams interfere. Coma of the extremum rays is reduced at least to the level of spherical aberration of the extremum rays.

It is possible to focus radiation and minimize its comatic aberration in a system of two spherical mirrors by selecting and orienting the mirrors to minimize both terms in the equation for coma discussed herein. It is also possible to minimize spherical aberration in such a system using an equation herein. Equations are also given herein for reducing the coma and spherical aberration in a four mirror system.

Those having normal skill in the art will recognize the foregoing and other objects, features, advantages and applications of the present invention from the following, more detailed description of the preferred embodiments as illustrated in the accompanying drawings.

BRIEF DESCRIPTION OF THE DRAWINGS

FIG. 5 is a table showing the parameters of the elements of the system of FIG. 4.

DETAILED DESCRIPTION OF THE PREFERRED EMBODIMENTS

Figure 1:
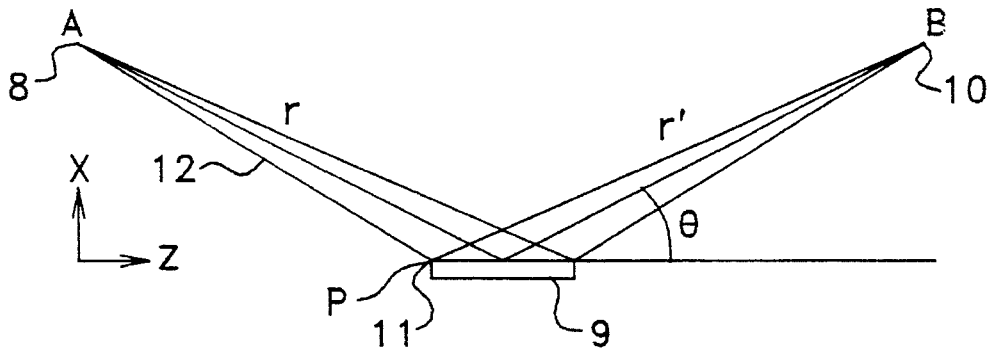
FIG. 1 is a side view of a spherical mirror showing beam path length.

FIG. 1 shows radiation from point 8, also designated as "A", reflecting off of spherical mirror 9, and focussing at point 10, also designated as "B". One ray of radiation 12 reflects at arbitrary point 11, designated "P", on sphere 9. The upper side of mirror 9 is actually the inner surface of a sphere which has a relatively large radius. Thus, the curvature of mirror 9 is not physically apparent in FIG. 1. Those skilled in the art will appreciate that a path length expansion for the path from A to P to B yields the following equation:

$$\langle AP\rangle+\langle PB\rangle=M_0+zM_1+z^2M_2+z^3M_3+z^4M_4+ \quad (1)$$

Where:

$$M_0 = r + r' \quad (2)$$

$$M_1 = 0 \quad (3)$$

$$M_2 = \frac{\sin^2\theta}{2r} + \frac{\sin^2\theta}{2r'} - \frac{\sin\theta}{R} \quad (4)$$

$$M_3 = \frac{\sin^2\theta}{2}\left[\frac{1}{r^{1^2}} - \frac{1}{r^2}\right] + \frac{\sin\theta\cos\theta}{2R}\left[\frac{1}{r} - \frac{1}{r^1}\right] \quad (5)$$

$$M_4 = \frac{\sin^2\theta}{2}\left[\frac{1}{r^3} + \frac{1}{r^{1^3}}\right]\left(1 - \frac{5\sin^2\theta}{4}\right) + \frac{\sin\theta}{2_R}\left[\frac{1}{r^2} + \frac{1}{r^{1^2}}\right]\left(\frac{3\sin^2\theta}{2} - 1\right) + \frac{1}{8R^2}\left[\frac{1}{r} + \frac{1}{r^1}\right](1 - \sin^2\theta) - \frac{\sin\theta}{4R^3} \quad (6)$$

$M_0$ is the total length of the central ray. The $M_1$ term is the center of focus. For $M_2$ and higher, $M_n$ is the nth order aberration of the system. The $M_2$ term indicates the amount the system is out of focus. The $M_3$ term gives the coma of the system. The $M_4$ term gives the spherical aberration of the system. $M_5$ gives the fifth order aberration, and so on. Each order of aberration is smaller than the preceding ones.

Figure 2:
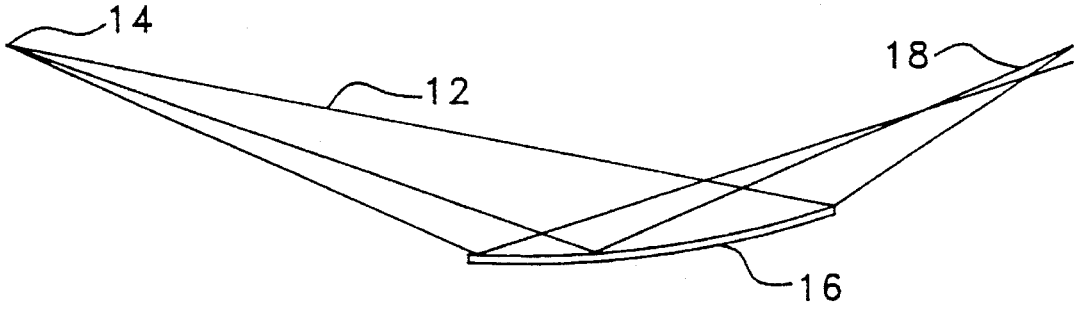
FIG. 2 is a side section view of a single mirror grazing incidence optical system for an x-ray beam.

FIG. 2 shows x-ray radiation 12 emanating from an object 14, reflecting off of spherical mirror 16, and converging to the right of mirror 16 to an approximate focus at point 18. No exact focus may be obtained for a one mirror system because of spherical and comatic aberrations. Spherical aberrations occur because rays from an on-axis object, striking the mirror surface at greater distances from the axis are focussed nearer to the mirror than rays striking the mirror nearer to its axis. Comatic aberration occurs because an object point off of the axis of the mirror does not focus to a single point in the image. In grazing incidence systems such as this one, comatic aberration dominates. Equation 7 below is the same as equation 4 above, and gives the parameters of a focussed system for a one mirror system. The system is approximately in focus when $M_2$=0. θ is the angle of incidence of beam 14 on mirror 16, r is the distance from the object point to the mirror, r' is the distance from the mirror to the image point, and R is the radius of curvature of mirror 16. If R is negative, the sphere is convex.

$$M_2 = \frac{\sin^2\theta}{2r} + \frac{\sin^2\theta}{2r'} - \frac{\sin\theta}{R} \quad (7)$$

Equation 8 gives the comatic aberration, $M_3$, for a one mirror system. It is evident from equation 8 that comatic aberration cannot be reduced to zero in a one mirror system, unless the distance to the object equals the distance to the focus point, which is generally impractical. For example, in telescopes, the distance to the object approaches infinity.

$$M_3 = \frac{\sin\theta}{2}\left(\frac{1}{r^1} + \frac{1}{r}\right)\left(\sin\theta\left(\frac{1}{r^1} + \frac{1}{r}\right) - \frac{\cos\theta}{2R}\right) \quad (8)$$

Most of the aberration in the focus comes from coma, and a system in which $M_3$ is reduced to zero will have a very good focus. For an even better focus, spherical aberration may be reduced to zero as well. Spherical aberration, $M_4$, in a single mirror system, is approximated by equation 9.

$$M_4 = \frac{\sin^2\theta}{2}\left(\frac{1}{r^3} + \frac{1}{r^{1^3}}\right) - \frac{\sin\theta}{2R}\left(\frac{1}{r^2} + \frac{1}{r^{1^2}}\right) + \frac{1}{8R^2}\left(\frac{1}{r} + \frac{1}{r^1}\right) \quad (9)$$

As in the case of coma, spherical aberration cannot be reduced to zero unless the distance to the object equals the negative of the distance to the focus point.

Figure 3:
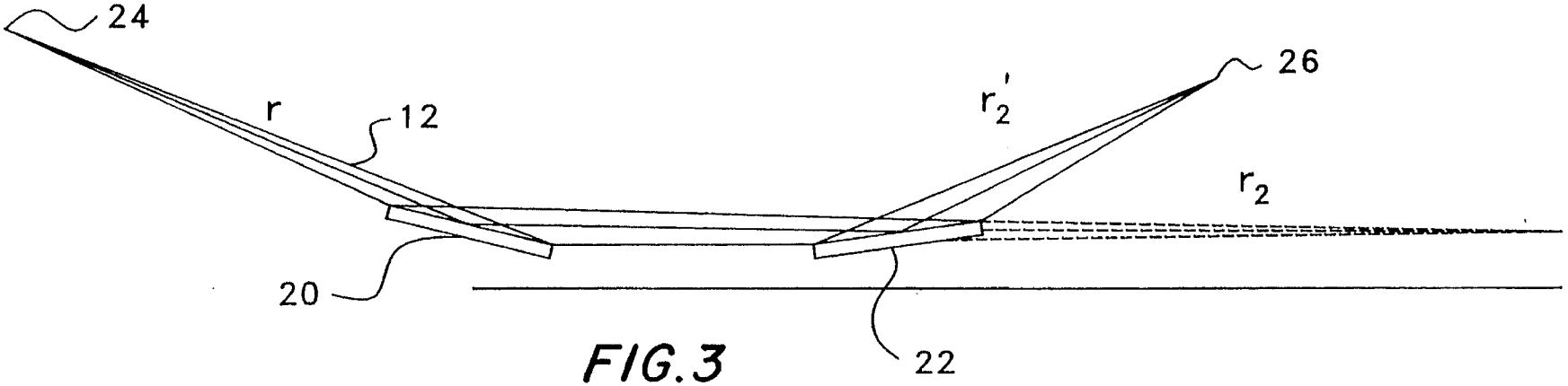
FIG. 3 is a side section view of a two mirror system in accordance with the present invention for focussing and correcting one dimension of the x-ray beam.

FIG. 3 shows x-ray radiation 12 in a two mirror system comprising mirrors 20 and 22. The radiation from a single object point 24 focusses to a line 26, which extends into and out of the page in FIG. 3. The focus is a line focus, with a very slight curvature in the second dimension. This curve results from the curve of the spheres in the second dimension, and can be significant if the line is long enough. Replacing the spheres with cylinders removes this effect entirely. Equation 10, for focus in a two sphere system, is given below. Both terms in parentheses must equal zero for an in-focus system, so the value of $\sigma_2$ is unimportant. In equation 10, θ is the graze angle of radiation 12 on mirror 20. $\theta_2$ is the graze angle on mirror 22. r is the distance from the object to the first mirror, 20. $r_2$ is the distance from the focus of mirror 20 to mirror 22. $r_2'$ is the distance from mirror 22 to the focal plane. r' is the distance from mirror 20 to the focus of mirror 20. R is the radius of curvature of mirror 20, and $R_2$ is the radius of curvature of mirror 22.

$$M_2 = \left(\frac{\sin^2\theta}{2r} + \frac{\sin^2\theta}{2r'} - \frac{\sin\theta}{R}\right) + \sigma_2\left(\frac{\sin^2\theta_2}{2r_2} + \frac{\sin^2\theta_2}{2r'_2} - \frac{\sin\theta_2}{R_2}\right) \quad (10)$$

r' is found by setting the first term in parentheses to zero, and then $r_2$ is found because $r'+r_2$ must equal the distance between the centers of the two spherical surfaces. In the system shown in FIG. 3, $r_2$ is negative.

Comatic aberration $M_3$, approximated by Equation 11, can be set to zero by choosing appropriate incident angles on the two mirrors 20 and 22 and the radius of the mirrors.

$$M_3=\left[\frac{\sin^2\theta}{2}\left(\frac{1}{r^{1^2}}-\frac{1}{r2}\right)+\frac{\sin\theta\cos\theta}{2R}\left(\frac{1}{r}-\frac{1}{r^1}\right)\right]+\sigma_3\left[\frac{\sin^2\theta_2}{2}\left(\frac{1}{r^{1^2}}-\frac{1}{R_2^2}\right)+\sin\theta_2\cos\frac{\theta_2}{2R_2}\left(\frac{1}{r_2}-\frac{1}{r_2^1}\right)\right] \quad (11)$$

$\sigma_3$ must be determined, since the value of $M_3$ is set to zero. In the past, those working in the field have used a value of $\sigma_3$ equal to $(r_2/r')^3$. This value is accurate for normal incidence systems, but the inventor discovered that the value of $\sigma_3$ is given by Equation 12:

$$\sigma_3=\frac{r_2^3\sin^3\theta}{r^{1^3}\sin 3\theta_2} \quad (12)$$

Of course, in normal incidence systems, the sin θ factor is close to one, and thus can be discounted.

Again, setting coma equal to zero results in a very good focus. It is possible to improve the focus even further by setting spherical aberration to zero. The equation for spherical aberration in a two mirror system is given by Equation 13 below.

$$M_4=\left[\frac{\sin^2\theta}{2}\left(\frac{1}{r^3}+\frac{1}{r^{1^3}}\right)-\frac{\sin\theta}{2R}\left(\frac{1}{r^2}+\frac{1}{r^{1^2}}\right)+\frac{1}{8R^2}\left(\frac{1}{r}+\frac{1}{r^1}\right)\right]+\sigma_4\left[\frac{\sin^2\theta_2}{2}\left(\frac{1}{r_2^3}+\frac{1}{r_2^{1^3}}\right)-\frac{\sin\theta_2}{2R_2}\left(\frac{1}{r_2^2}+\frac{1}{r_2^{1^2}}\right)+\frac{1}{8R_2^2}\left(\frac{1}{r_2}+\frac{1}{r_2^1}\right)\right] \quad (13)$$

$M_4$ can also be set to zero by choosing appropriate incident angles of the two mirrors 20 and 22 and the radius of the mirrors.

The inventor has discovered that $\sigma_4$ in Equation 13 appears to be given by:

$$\sigma_4=\frac{r_2^4\sin^4\theta}{r_2^{1^4}\sin^4\theta_2} \quad (14)$$

In general, for multiple element systems, Equation 15 gives the focus, comatic aberration, and spherical aberration terms.

$$M_k=\sum_i\frac{r_i^k\sin^k\theta}{r^{1^k}\sin^k\theta_i}M_{ik} \quad (15)$$

Where the summation is over the mirrors i.

This invention is based on the use of spherical surface mirrors, but those skilled in the art will appreciate that near-spherical surfaces may also be used. The sphere is the most basic optical shape available, the natural configuration resulting from polishing two surfaces together, as two spherical surfaces of the same radius may slide scale free and direction free against each other. As a result, it is possible to fabricate a very high quality sphere at modest cost. Spheres have excellent figure and polish, low cost and general availability. Thus, spheres are generally available, and form the basis of the invention. However, some deviation from a true sphere can, in certain cases, improve the system performance. For example, cylinders can replace spheres and remove the curvature from the line focus. Similarly, adding some eccentricity to the sphere, usually in the form of a large hyperbolic eccentricity, can allow additional control of spherical aberration, and hence produce a faster system. Toroids may be similarly useful.

A major roadblock to the fabrication of grazing incidence optics has been the reduction of the mid-frequency ripple (circa one millimeter scale) which causes scatter of the x-ray, while simultaneously controlling figure. It is a central advantage of the sphere, that the rotational freedom in the polish process removes virtually all mid-frequency error.

Figure 4:
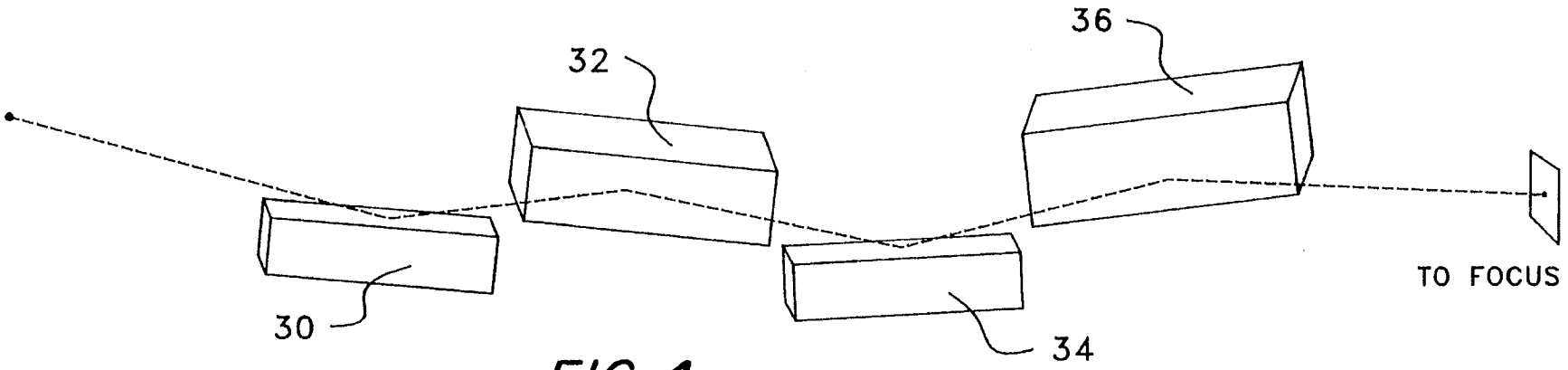
FIG. 4 is a side section view of a four mirror system in accordance with the present invention for focussing and correcting two dimensions of an x-ray beam.

FIG. 4 shows a two dimensional imaging system with four spherical mirrors, 30, 32, 34, and 36 in accordance with the present invention. The curvature of mirrors 30, 32, 34, and 36 is not apparent in FIG. 4 because the radii of curvature are so large. Two of the mirrors, 30 and 34, focus and correct the beam in the X direction, as was shown in FIG. 3. The other two mirrors, 32 and 36, focus and correct the beam in the Y direction, resulting in true, two dimensional focus in the image plane without significant comatic and (if desired) spherical aberration. Each mirror is oriented at right angles to the next, about the converging beam. The positioning of the orthogonal spheres must be adjusted to ensure they do not physically interfere.

Thus, in order to focus an object point to an image point, four mirrors are used in the present invention. One mirror is used to focus in each dimension, and one mirror is used to correct spherical and comatic aberration in each dimension. The Kirkpatrick and Baez approach used only two mirrors, to focus the two directions, leaving significant aberrations. In the preferred embodiment shown in FIG. 4, all four mirrors are concave and all are located next to each other, with the gap between the mirrors small compared to the length of the mirrors. Each mirror is about 1 cm wide and 28.6 cm long, with appropriate thickness for stiffness. Mirrors 30 and 34 have their surfaces reflecting X-rays in the plane of the page, and mirrors 32 and 36 reflect X-rays out of the plane of the page. The angles have been exaggerated for clarity.

The preferred embodiment of FIG. 4 is a telescope that focusses parallel light incident on a one-square centimeter entrance aperture (not shown) to a five micron square focus (not shown) over a distance of about three meters. The telescope comprises the four spherical mirrors, 30, 32, 34, and 36. The specific design given in FIG. 5 is essentially coma free, but spherical aberration has not been removed because it is already so small. In other designs and configurations, it may be desirable to reduce or remove spherical aberration.

FIG. 5 is a table defining the location and orientation of the four mirrors in one specific example of the preferred embodiment. In the preferred embodiment, mirrors 30 and 34 focus and correct in the X direction, and mirrors 32 and 36 focus and correct in the Y direction. In practice, the order of the elements does not matter. For each of the four mirrors, the radius of curvature is given in the table in column 2 or 3. The separation between the center point of each mirror and the center point of the mirror preceding it is also given. The angle at which the x-ray radiation glances off of each mirror is given as well. Notice that each mirror is to have a length of up to 300 millimeters, allowing the mirrors to be interleaved. The values of the comatic and spherical aberration coefficients are shown, both for each mirror and for the combinations of mirrors 30 and 34 and mirrors 32 and 36. The total coma, given by $z^3M_3$ (see Equation 1), is less than one percent of the coma for each mirror alone. The total coma ($z^3M_3$) has been reduced to the level of total spherical aberration ($z^4M_4$), for values of z (distance off axis) greater than 30 mm. Thus, this design is performance limited purely by spherical aberration. The extremum rays (those at the edge of the lens) which have the worst aberrations of all types, have coma reduced to well below the level of spherical aberration. Spherical aberration was not corrected, because the values were already so small. Those skilled in the art will appreciate that it would be straightforward to implement a design with both comatic and spherical aberrations removed, and it may be desirable in other configurations.

The focal plane is the plane in which the image is focussed. In the preferred embodiment, it is oriented at 90-degrees to the converging beam. Classes of solutions exist that provide a wider field of view normal to the converging beam, many involving more than four reflections. The focal plane is located 2101.03 millimeters from mirror 36.

The alignment tolerances of the four elements are remarkably loose, given the quality of the image. This is predominantly the effect of the very slow nature of the beam, typically around f/300. The ability to meet the surface tolerance requirements for a 0.5 arcsecond image, for example, is easily accomplished with current spherical optics polishing techniques. The tightest positional tolerance between any two elements of the system for such an image is 0.3 mm. The tightest angular constraint is 10 arcseconds. These can be easily achieved and maintained.

Those skilled in the art will appreciate that many variations to the preferred embodiment described herein are possible. For example, the apparatus geometries described herein may be adjusted for use at a variety of graze angles. Angles near 10-degrees support wavelengths of order 10 nm and longer. Angles of 2-degrees support wavelengths of order 1nm and longer. Of particular interest are the designs with graze angles below 0.5-degrees. At these low angles, x-rays with wavelengths on the order of 0.1 nm can be focused, allowing the systems to operate without the necessity of vacuum chambers. Convex spheres can play a very useful role in design optimization, particularly in creating wide field of view designs.

The present invention has a variety of areas of application, including telescopes, microscopes, relay optics, collimators, and interferometers. In essence, each four mirror combination plays the role of a lens in the x-ray region, allowing the full array of applications of lenses in the visible part of the spectrum to be transferred to the x-ray region. And, as coupling lenses in series leads to more versatile designs, so does coupling more sets of x-ray spheres.

Figure 6:
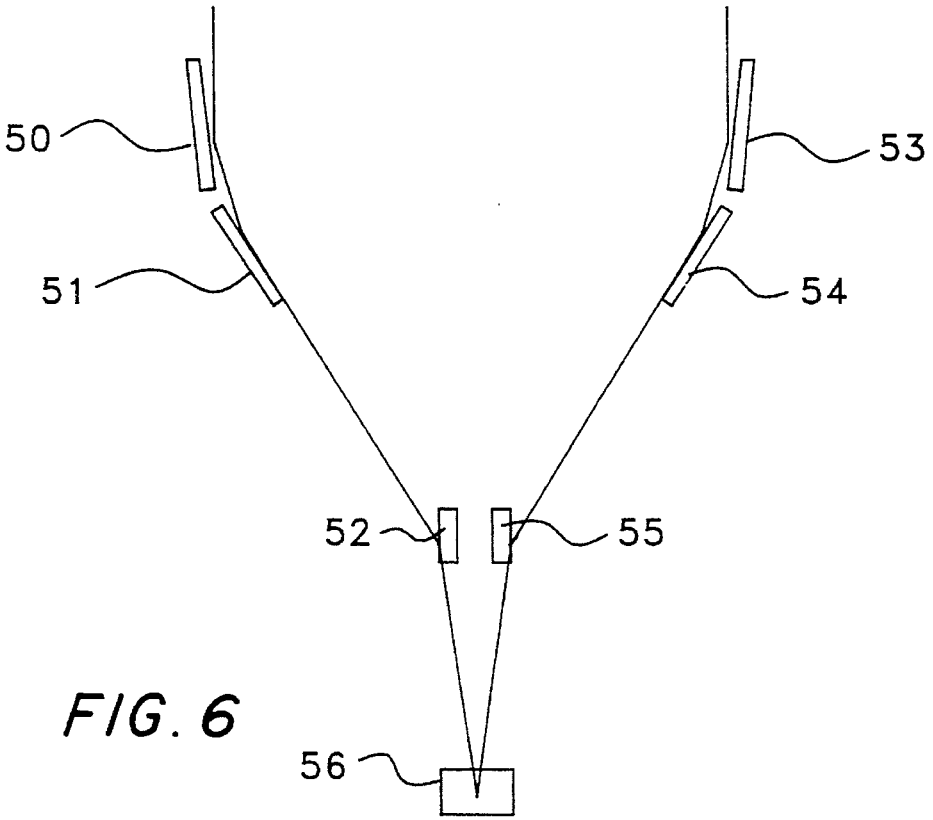
FIG. 6 is a side section view of an interferometer in accordance with the present invention.

For example, the very high quality of the focus and the ability to control the effective focal length of the present invention allow the design of an x-ray interferometer, as shown in FIG. 6. Spheres 50 and 51 create a high quality line focus on focal plane 56 that is limited only by diffraction. Sphere 52 magnifies the focus, and flattens the field of view onto the detector 56. Spheres 53, 54, and 55 create an identical beam focussing to the same line on 56. The diffraction envelope will modulate at $\lambda/D$ angular spacing, where D is the separation of spheres 50 and 53, greatly enhancing the limiting resolution over devices known in the art. For example, if D is 20 centimeters, and $\lambda$ is 10 Angstroms, the resolution is $2\times10^8$, or 0.001 arcseconds.

The present invention uses grazing incidence, which is more efficient than other x-ray optics systems. Unlike the multilayer and zone plate designs, grazing incidence systems focus all the radiation up to a cutoff energy set by the graze angle. Efficiencies in the 10–50% range are typical.

Furthermore, the present invention gives better image quality than previous systems. With well polished and figured spheres in a well designed four (or more) element system, the limit to resolution is the diffraction limit, well before the aberrations become significant. For example, with a numerical aperture of 0.01, operating at 0.1 nm, the limiting spot size is 0.01 microns.

While the exemplary preferred embodiments of the present invention are described herein with particularity, those having normal skill in the art will recognize various changes, modifications, additions, and applications, other than those specifically mentioned herein, without departing from the spirit of this invention.

What is claimed is:

1. Apparatus for processing incident radiation between an object and a focal plane comprising:

a first mirror having a spherical surface;

a second mirror having a spherical surface; and means for orienting said first and second mirrors such that the object radiation reflects off said first mirror spherical surface in grazing orientation, and then reflects off said second mirror spherical surface in grazing orientation onto the focal plane, whereby comatic aberration of extremum rays is reduced at least to the level of spherical aberration of extremum rays.

2. The apparatus of claim 1 wherein said orienting means further includes means for orienting said two mirrors such that spherical aberration of extremum rays and comatic aberration of extremum rays are reduced at least to the level of fifth order aberration of extremum rays.

3. Apparatus for focussing incident radiation in two dimensions onto a focal plane, with said radiation emanating from an object, said apparatus comprising:

a first spherical mirror;

a second spherical mirror;

a third spherical mirror;

a fourth spherical mirror; and means for orienting said four mirrors between the object emanating radiation and the focal plane for reflecting the radiation off each said mirror in grazing orientation, whereby the radiation is reflected first off of said first mirror, then off of said second mirror, then off of said third mirror, then off of said fourth mirror into focus at the focal plane, and such that comatic aberration of extremum rays in each dimension is reduced at least to the level of spherical aberration of extremum rays.

4. The apparatus of claim 3 wherein said orienting means further includes means for orienting said four mirrors such that spherical aberration of extremum rays and comatic aberration of extremum rays in both dimensions are reduced at least to the level of fifth order aberration of extremum rays.

5. Apparatus for interfering two beams of x-ray radiation at a focal plane comprising:

at least six spherical mirrors;

means for orienting three of said six mirrors such that a first of the two beams reflects off of the first said mirror at grazing orientation and then off of the second said mirror at grazing orientation and then off of the third said mirror at grazing orientation into focus at the focal plane, and such that the comatic aberration of extremum rays is reduced at least to the level of spherical aberration of extremum rays; and means for orienting the other three said mirrors such that the second of the two beams reflects off of the fourth said mirror at grazing orientation and then off of the fifth said mirror at grazing orientation and then off of the sixth said mirror at grazing orientation into focus at the focal plane and such that the comatic aberration of extremum rays is reduced at least to the level of spherical aberration of extremum rays and such that the second beam interferes with the first beam.

6. The method of line focussing incident x-ray radiation from an object to a focal plane in an optical system of at least first and second spherical mirrors comprising the steps of:

positioning said first mirror for reflecting said x-ray radiation in grazing orientation towards said second mirror, and orienting said second mirror for reflecting radiation from said mirror in grazing orientation in to focus at said focal plane, whereby comatic aberration of extremum rays is reduced at least to the level of spherical aberration of extremum rays.

7. The method of claim 6 wherein said positioning and orienting steps further include the steps of selecting and orienting said two mirrors to reduce spherical aberration of extremum rays and comatic aberration of extremum rays at least to the level of fifth order aberration of extremum rays.

8. The method of focussing incident x-ray radiation in two dimensions, said radiation emanating from an object and focussed onto a focal plane in an optical system of at least four spherical mirrors comprising the steps of:

positioning a first of said mirrors for receiving said emanating radiation for reflection in grazing orientation toward the second said mirror;

orienting the second of said mirrors for receiving said emanating radiation from said first mirror for reflection in grazing orientation, locating the third said mirror for reflection emanating radiation from said second mirror in grazing orientation; and placing the fourth said mirror for receiving said emanating radiation from said third mirror for reflection in grazing orientation, whereby the comatic aberration of extremum rays in each dimension is reduced at least to the level of spherical aberration of extremum rays.

9. The method of claim 8 wherein said positioning, orienting, locating, and placing steps further include the steps of selecting and orienting said four mirrors to reduce spherical aberration of extremum rays and comatic aberration of extremum rays in both dimensions at least to the level of fifth order aberration of extremum rays.

10. Apparatus for line focussing incident x-ray radiation from an object to a focal plane comprising:

a first mirror having a spherical surface of radius R;

a second mirror having a spherical surface of radius $R_2$;

means for orienting said two mirrors in grazing orientation relative to the radiation, such that the radiation reflects off of said first mirror surface onto said second mirror surface and focusses on the focal plane by minimizing both terms in parenthesis in the equation:

$$M_2=\left(\frac{\sin^2\theta}{2r}+\frac{\sin^2\theta}{2r'}-\frac{\sin\theta}{R}\right)+\sigma_2\left(\frac{\sin^2\theta_2}{2r_2}+\frac{\sin^2\theta_2}{2r'_2}-\frac{\sin\theta_2}{R_2}\right) \tag{16}$$

and such that comatic aberration $M_3$ is minimized by minimizing the equation:

$$M_3=\left[\frac{\sin^2\theta}{2}\left(\frac{1}{r^{1^2}}-\frac{1}{r2}\right)+\frac{\sin\theta\cos\theta}{2R}\left(\frac{1}{r}-\frac{1}{r^1}\right)\right]+\sigma_3\left[\frac{\sin^2\theta_2}{2}\left(\frac{1}{r^{1^2}}-\frac{1}{r_2^2}\right)+\sin\theta_2\cos\frac{\theta_2}{2R_2}\left(\frac{1}{r_2}-\frac{1}{r_2^1}\right)\right] \tag{17}$$

where θ is the graze angle of the radiation on said first mirror, $\theta_2$ is the graze angle of the radiation on said second mirror, r is the distance from the object to said first mirror, $r_2$ is the distance from the focus of said first mirror to said second mirror, $r_2'$ is the distance from said second mirror to the focal plane, r' is the distance from said first mirror to the focus of said first mirror, and where:

$$\sigma_3=\frac{r_2^3\sin^3\theta}{r^{1^3}\sin3\theta_2} \tag{18}$$

11. The method of line focussing incident x-ray radiation from an object to a focal plane in an optical system of two spherical mirrors, in grazing orientation to the radiation, so that the radiation reflects off of the first mirror onto the second mirror and focusses on the focal plane, comprising the steps of:

configuring said first and second mirrors with spherical surface segments having respective radii of R and $R_2$;

orienting said two mirrors to focus the radiation at the focal plane by minimizing both terms in parentheses in the equation:

$$M_2=\left(\frac{\sin^2\theta}{2r}+\frac{\sin^2\theta}{2r'}-\frac{\sin\theta}{R}\right)+\sigma_2\left(\frac{\sin^2\theta_2}{2r_2}+\frac{\sin^2\theta_2}{2r'_2}-\frac{\sin\theta_2}{R_2}\right) \tag{19}$$

and minimizing comatic aberration Ms by minimizing the equation:

$$M_3=\left[\frac{\sin^2\theta}{2}\left(\frac{1}{r^{1^2}}-\frac{1}{r2}\right)+\frac{\sin\theta\cos\theta}{2R}\left(\frac{1}{r}-\frac{1}{r^1}\right)\right]+\sigma_3\left[\frac{\sin^2\theta_2}{2}\left(\frac{1}{r^{1^2}}-\frac{1}{r_2^2}\right)+\sin\theta_2\cos\frac{\theta_2}{2R_2}\left(\frac{1}{r_2}-\frac{1}{r_2^1}\right)\right] \tag{20}$$

where e is the graze angle of the radiation on said first mirror, $\theta_2$ is the graze angle of the radiation on said second mirror, r is the distance from the object to said first mirror, $r_2$ is the distance from the focus of said first mirror to said second mirror, $r_2'$ is the distance from said second mirror to said focal plane, and r' is the distance from said first mirror to the focus of said first mirror, and where:

$$\sigma_3=\frac{r_2^3\sin^3\theta}{r^{1^3}\sin3\theta_2} \tag{21}$$

* * * * *